United States Patent [19]

Kitayama et al.

[11] 4,190,468

[45] Feb. 26, 1980

[54] PROCESS FOR COATING AN ELECTRICAL STEEL SHEET WITH AN ANTI-STICKING LAYER

[75] Inventors: Minoru Kitayama; Motoharu Nakamura, both of Himeji, Japan

[73] Assignee: Nippon Steel Corporation, Tokyo, Japan

[21] Appl. No.: 932,508

[22] Filed: Aug. 10, 1978

[30] Foreign Application Priority Data

Aug. 15, 1977 [JP] Japan ..... 52-97632

[51] Int. Cl.[2] ..... C21D 1/18; C21D 1/26; C21D 1/78

[52] U.S. Cl. ..... 148/12 A; 148/6.14 R; 148/12.1; 148/111; 427/369

[58] Field of Search ..... 148/31.5, 31.55, 31.57, 148/105, 110, 111, 112, 113, 121, 122, 12 A, 12.1, 6.14 R; 427/369

[56] References Cited

U.S. PATENT DOCUMENTS

| | | | |
|---|---|---|---|
| 2,492,095 | 12/1949 | Gifford | 148/31.5 |
| 2,593,922 | 4/1952 | Robison et al. | 148/31.5 |
| 2;809,137 | 10/1957 | Robinson | 148/113 |
| 3,114,661 | 12/1963 | Palm | 148/122 |
| 3,310,870 | 3/1967 | Parikh et al. | 427/369 |
| 3,523,837 | 8/1970 | Pavlik | 148/113 |
| 3,647,567 | 3/1972 | Schweri | 148/31.5 |
| 3,793,073 | 2/1974 | Kitayama et al. | 148/31.5 |
| 3,932,235 | 1/1976 | Foster | 148/31.5 |
| 3,941,621 | 3/1976 | Lee et al. | 148/31.5 |

FOREIGN PATENT DOCUMENTS

| | | | |
|---|---|---|---|
| 2062906 | 7/1972 | Fed. Rep. of Germany | 427/369 |

*Primary Examiner*—L. Dewayne Rutledge
*Assistant Examiner*—Michael L. Lewis
*Attorney, Agent, or Firm*—Wenderoth, Lind & Ponack

[57] ABSTRACT

A method for providing an annealed electrical steel sheet which is highly resistant to sticking to another sheet superimposed thereon at a high temperature, is provided by forming, on the surrace of the sheet, an anti-sticking layer consisting essentially of a colloidal inorganic substance, for example, colloidal silica, alumina and lithium silicate and, optionally, a film-forming organic resinous substance, for example, an acrylic polymer, vinyl acetate polymer and polyester resins.

5 Claims, 1 Drawing Figure

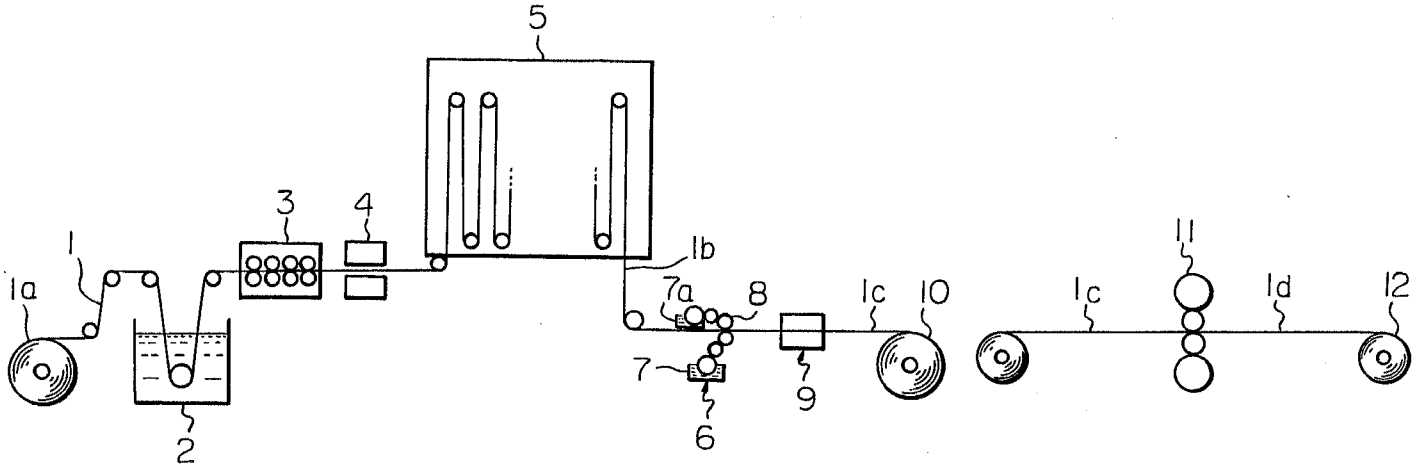
1a
1
2
3
4
5
1b
7a
7
6
8
9
1c
10
1c
11
1d
12

PROCESS FOR COATING AN ELECTRICAL STEEL SHEET WITH AN ANTI-STICKING LAYER

FIELD OF THE INVENTION

The present invention relates to an electrical steel sheet coated with an anti-sticking layer and a process for producing the same. More particularly, the present invention relates to an electrical steel sheet coated with an anti-sticking layer for preventing cores made from the sheet and superimposed on each other, from undesirable sticking to each other, during a stress relief annealing process for removing strains from the cores, and a process for producing the same without causing any environmental pollution.

BACKGROUND OF THE INVENTION

It is known that a conventional electrical steel sheet usable for producing a motor or transformer is made of a silicon-containing electrical steel or a non-silicon-containing electrical steel. Also, it is known that the conventional electrical steel sheet is coated with an electrically insulating layer. This insulating layer is effective for decreasing eddy-current loss in a core and for increasing resistance to corrosion of the core. The term core as used herein means a punched sheet which has been produced by punching the electrical steel sheet. The insulating layer is also effective for increasing the punching property of the sheet and for preventing the sticking of cores made from the sheets to each other during a stress relief annealing process. However, the formation of the insulating layer is expensive.

Recently, in order to greatly reduce the cost in the production of an electrical steel sheet, the tendency has been to utilize a low carbon lamination steel sheet. In this case, usually, a low carbon lamination steel sheet is continuously annealed and, thereafter, temper-rolled at a reduction of 0.2 to 10%, in order to increase the hardness of the sheet and improve the punching property of the sheet. The temper-rolling processes are also effective for accelerating the growth of crystals on the core during the stress relief annealing process. Such temper-rolled electrical steel sheets are sold as semi-processed electrical steel sheets to users. Usually, the electrical steel sheets are subjected by the users to the punching process for producing desired cores and the stress relief annealing process.

In the case where the electrical steel sheets, which are not coated with the insulating layer, are punch-shaped, and the resultant cores are superimposed on each other and annealed in an annealing furnace, the cores frequently stick to each other. This sticking results in reduction of the magnetic property of the cores. When the cores are stuck, it is necessary to peel them from each other. The peeling operation causes the annealing process to have a low efficiency.

In order to eliminate the above-mentiond disadvantages of the conventional electrical steel sheet and the process for producing the same, the following approaches were proposed.

1. The punched cores were coated with a refractory material. However, this process of applying the refractory material onto the surface of the cores had a low efficiency and resulted in a high coat. Also, when such a shaped core was annealed, the resultant core had a poor space factor and undesirable appearance due to the refractory material layer formed on the core surface.

2. When the cores were stuck to each other during the stress relief annealing process, the cores were peeled from each other mechanically by, for example, vibrating or bending the stuck cores. However, the use of the vibrating or bending method resulted in the cost of the stress relief annealing process being high. Also, the vibrating or bending operation sometimes caused the cores to be stressed and, therefore, to have a poor magnetic property.

3. The surfaces of the electrical steel sheets were roughened so as to make the shaped cores easily separable from each other. This method was tried in the U.S.A. and applied to low carbon lamination steel sheets. The roughened surface was formed by using a dull rolling mill having a rough-surfaced roller. These rough surfaced electrical steel sheets could be easily decarbonized during the stress relief annealing. However, this method was disadvantageous in that when the rough-surfaced electrical steel cores were stress relief annealed, the resultant annealed cores had a poor space factor and magnetic property.

4. In the annealing process for eliminating internal strains from the shaped steel cores, the cores were fed, one after the other, into a continuous annealing furnace without superimposing the cores on each other. However, this method resulted in a high cost and, also, the continuous annealing furnace for this process was expensive.

In the field of surface treating the usual cold rolled steel sheet, one technical approach has been developed wherein a surface of a cold rolled steel sheet is coated with a treating solution containing 5 to 150 g/l of chromic acid, 5 to 200 g/l of a silicon oxide sol or aluminum oxide sol and 5 to 100 g/l of at least one metal compound and; the coated sheet is baked at a high temperature of 400° C. or more. Since the treating solution contains a considerable amount of chromic acid which is not permitted to be discharged from the factory, the chromic acid should be removed from the waste liquid of the above-mentioned method before the waste liquid is discharged from the factory. Furthermore, the high temperature baking process undesirably consumes a large amount of energy.

Under the above-mentioned circumstances, it is strongly desirable to provide a new type of anti-sticking electrical steel sheet and a process for producing the same, which are completely free of the above-mentioned disadvantages.

SUMMARY OF THE INVENTION

An object of the present invention is to provide an electrical steel sheet coated with an anti-sticking layer which is easily formed at a relatively low temperature and which is effective for preventing undesirable sticking of the cores superimposed on each other during a stress relief annealing process at a high temperature, and a process for producing the same.

Another object of the present invention is to provide an electrical steel sheet coated with an anti-sticking layer which is highly resistant to peeling during a temper rolling process, and a process for producing the same.

A further object of the present invention is to provide an electrical steel sheet coated with an anti-sticking layer which does not cause any environmental pollution, and a process for producing the same.

The above-mentioned objects can be attained by the electrical steel sheet and the process for producing the same of the present invention. The electrical steel sheet of the present invention comprises an electrical steel sheet which has been continuously annealed, and an anti-sticking layer formed on at least one surface of the electrical steel sheet by coating the surface with a coating liquid containing at least one colloidal inorganic substance and by drying the coating liquid on the surface, the anti-sticking layer having a weight of from 0.02 to 0.8g per $m^2$ of the surface. This anti-sticking layer can be highly resistant to peeling during the temper rolling.

Also, the process of the present invention comprises coating at least one surface of an electrical steel sheet which has been continuously annealed, with a coating liquid containing at least one colloidal inorganic substance and being in an amount sufficient enough to a dry anti-sticking layer having a weight of 0.02 to 0.8g per $m^2$ of the surface, and; drying the coating liquid on the surface.

BRIEF DESCRIPTION OF THE DRAWING

The accompanying drawing is an explanatory view of an apparatus for carrying out the process of the present invention.

DETAILED DESCRIPTION OF THE INVENTION

Referring to the accompanying drawing, the electrical steel sheet usuable as a starting material for the process of the present invention can be provided by continuously cleaning a cold-rolled electrical steel sheet 1 withdrawn from a coil 1*a*, in a cleaning bath 2, for example, electrolytic cleaning bath; washing the sheet with water in a scrubber 3; drying the cleaned sheet in a blower 4, and; then, annealing the dried sheet in a continuous annealing furnace 5 at a temperature of from 600 to 850° C. The starting electrical steel sheet may be produced by coldrolling a low carbon laminated steel sheet, for example, rimmed steel, capped steel or killed steel, containing 0.1% by weight or less of carbon and 0.5% by weight or less of manganese in accordance with a conventional cold-rolling process. Usually, the cold-rolled electrical steel sheet has a thickness of 1 mm or less. The cleaning operation can be carried out by any of the conventional cleaning methods, for example, an electrolytic cleaning method.

It is preferable that the electrical steel sheet to be subjected to the process of the present invention have a smooth surface. In this case, the electrical steel sheet has an excellent space factor and magnetic property. However, the electrical steel sheet usable for the present invention is not limited to the smooth surfaced electrical steel sheet and, therefore, may have a slightly roughened surface. Sometimes, the slightly rough-surfaced electrical steel sheet can be more easily temper rolled than the smooth surfaced electrical steel sheet. However, the slightly roughened surface of the electrical steel sheet is not always effective for preventing the sticking of the electrical steel core to other cores during the stress relief annealing process. When the surface of the electrical steel sheet is smooth, it is preferable that the electrical steel sheet be produced from a decarbonized electrical steel melt.

The annealed electrical steel sheet is subjected to the process of the present invention. Referring to the accompanying drawing, the annealed electrical steel sheet 1*b* is fed into a coating device 6. In the device 6, a coating liquid is contained in an upper vessel 7*a* and a lower vessel 7*b* and applied onto both surfaces of the annealed sheet 1*b* by three pairs of coating rollers 8. The coating liquid on the surfaces of the annealed sheet 1*b* is dried by means of a dryer 9, if necessary. Thereafter, the coated electrical steel sheet 1*c* is wound to form a coil 10.

The coated electrical steel sheet 1*c* is temper rolled by a temper rolling machine 11 at a reduction of, preferably, 0.2 to 10%, and the temper rolled sheet 1*d* is wound to form a coil 12.

The coating liquid contains at least one colloidal inorganic substance and may be applied onto either one or both of the surfaces of the electrical steel sheet, in accordance with any conventional coating method, for example, spraying or roll-coating. The colloidal inorganic substance may be selected from the group consisting of colloidal silica, alumina sol, colloidal titanium oxide, colloidal lithium silicate and colloidal artificial mica.

The colloidal inorganic substances described above can form the anti-sticking layer on the surface of the electrical steel sheet. This layer is very effective for preventing the undesirable sticking of the core to another core superimposed on it during the stress relief annealing process, even if the layer is relatively thin. Accordingly, when the coated electrical steel sheet is punched with a punching die, the anti-sticking layer does not cause a decrease in the durability of the punching die. For example, a super hard punching die can be used well over a million times for punching the coated electrical steel sheet.

The coating liquid can also contain, in addition to the colloidal inorganic substance, at least one film-forming organic resinous substance. The organic resinous substance may be selected from, for example, the group consisting of acrylic polymers, vinyl acetate polymers, polyester resins, alkid resins, maleic acid resins, polyamide resins, phenol resins, melamine resins epoxy resins and urea resins.

The above-described organic resinous substance mixed with the colloidal inorganic substance in the antisticking layer, is effective for increasing the durability of the punching die used for punching the coated electrical steel sheet. The organic resinous substance may be present either in the form of an aqueous solution or an emulsion in the coating liquid. Generally speaking, the larger the content of the organic resinous substance in the antisticking layer, the higher the effect in increasing the durability of the punching die. However, the large content of the organic resinous substance causes the resultant anti-sticking layer to have a low hardness and, therefore, can be easily scratched. Also, the anti-sticking layer having a large content of the organic resinous substance exhibits a relatively low anti-sticking effect in the stress relief annealing process. Accordingly, in the case where the organic resinous substance is used, it is preferable that the content of the organic resinous substance be 50% or less based on the dry weight of the inorganic substance.

The drying operation for the coating liquid layer formed on the surface of the annealed electrical steel sheet may be carried out by blowing air, if necessary, hot air, onto the coating liquid layer. However, in order to conserve energy during the drying operation, it is preferable that the coating liquid layer be dried by the heat remaining in the annealed electrical steel sheet itself. In this case, the annealed electrical steel sheet is withdrawn at a temperature of about 200° C. or less from the continuous annealing furnace, and then, coated with the coating liquid, and the coating liquid on the sheet surface is dried by the heat of the annealed sheet which has a temperature of from 50 to 150° C.

A temperature of the annealed electrical steel sheet lower than 50° C. sometimes results in a long drying period for the coating solution layer and, also, in a loose structure of the resultant dried anti-sticking layer. A temperature higher than 150° C. sometimes results in rapid boiling of the coating liquid when applied onto the sheet surface and, therefore, in uneven thickness and structure of the resultant anti-sticking layer. Accordingly, it is preferable that the drying operation be carried out while the annealed electrical steel sheet is maintained at a temperature of from 50° to 150° C. In this case, the drying operation may be accelerated by blowing air toward or in parallel to the coating liquid layer. The utilization of the heat remaining in the annealed sheet in the drying process of the coating liquid layer is effective for conserving energy.

After the drying operation is completed, the dried, coated electrical steel sheet is usually subjected to a temper rolling process before the punching and stress relief annealing process. Generally, in order to ensure the anti-sticking effect, it is preferable that the antisticking layer have a relatively large thickness. However, in order to carry out the temper rolling process at a reduction of 0.2 to 10.0% without breakage of the antisticking layer, it is preferable that the anti-sticking layer be as thin as possible. Accordingly, it was found that in order to satisfy the above-described two requirements which conflict with each other, the anti-sticking layer should have a thickness corresponding to the weight of 0.02 to 0.8 g per $m^2$ of the sheet surface. This range of the weight of the anti-sticking layer was determined based on the following facts.

When a plurality of the coated electrical steel cores are stuck to each other during the stress relief annealing process under a pressure of, for example, 20 $kg/m^2$, as long as the sticking strength of the cores is about 100 $g/cm^2$ or less, the cores are easily peeled from each other. However, when the weight of the anti-sticking layer is less than 0.02 $g/m^2$, the sticking strength of the cores will be more than 100 $g/cm^2$ and, therefore, the stuck cores are difficult to separate from each other.

The anti-sticking layer should be firmly fixed to the core surface and should not peel or scratch during any processes before the stress relief annealing process. In this connection, it was found that the anti-sticking layer having a weight more than 0.8 $g/m^2$ sometimes peels from the sheet surface during a temper rolling process at a reduction of 5%. Also, it was sometimes found that when the coating liquid layer is incompletely dried, the resultant anti-sticking layer is stickly and easily removed from the sheet surface. The present invention will be further illustrated by the following examples which are not intended to limit the scope of the present invention.

EXAMPLES 1 THROUGH 5 AND COMPARISON EXAMPLES 1 THROUGH 3

In each of the Examples 1 through 5 and Comparison Examples 1 through 3, a rimmed steel slab was hot rolled to form a sheet having a thickness of 2.3 mm, washed with an acid cleaning solution and, then, cold rolled to reduce the thickness of the plate to 0.5 mm. The resultant electrical steel sheet was fed into the apparatus as illustrated in the accompanying drawing. The sheet was degreased with an aqueous solution of 3% of weight of sodium silicate in an electrolytic cleaning bath, washed with water in a scrubber and, then, dried in a hot air dryer. The dried electrical steel sheet was annealed at a temperature of 680° C. in a continuous annealing furnace. At a stage at which the annealed sheet had a temperature of 110° C., an aqueous coating liquid containing 300 g/l of a 30% by weight colloidal silica was applied in an amount corresponding to the weight of the resultant anti-sticking layer as shown in Table 1 onto both surfaces of the sheet by using the coating rollers shown in the accompanying drawing. The coating liquid layer was completely dried within 1 second by the heat of the annealed sheet itself. The resultant coated electrical steel sheet was temper rolled at a reduction of 5%. The anti-sticking layer of the temper rolled sheet exhibited a degree of roughness of the surface of 0.8 in terms of maximum height, Hmax. The sheet was punched with a super hard punching die for the core of a motor. The shaped cores were superimposed on each other and annealed at a temperature of 750° C. for 2 hours in a nitrogen atmosphere to remove the strains from the plates.

The sticking strength of the cores, the durability of the punching die by which the sheets were punched, and features of the dried anti-sticking layer on the sheets are shown in Table 1. In order to determine the durability of the punching die the punching operations were repeatedly applied to the sheet until a burr 50 microns high was formed on the edge of the coil. The durability of the punching die is indicated by the number of the punching operations it took for the height of the burr to reach 50 microns. The durability of the punching die corresponds to the punchability of the coated electrical steel sheet.

EXAMPLES 6 THROUGH 8 AND COMPARISON EXAMPLES 4 THROUGH 7

In each of the Examples 6 through 8 and Comparison Examples 4 through 7, the same procedures as those mentioned in Example 1 were carried out, except that a coating liquid containing 100 g/l of a 10% by weight alumina sol, in place of the colloidal silica, was applied in an amount corresponding to a weight of the resultant anti-sticking layer shown in Table 1. The results are shown in Table 1.

EXAMPLES 9 THROUGH 13 AND COMPARISON EXAMPLES 8 THROUGH 10

In each of the Examples 9 through 13 and Comparison Examples 8, 9 and 10, the same operations as those mentioned in Example 1 were carried out, except that a coating liquid containing 200 g/l of a 30% by weight colloidal lithium silicate, in place of the colloidal silica, was applied in an amount corresponding to the weight of the resultant anti-sticking layer shown in Table 1. The results are also shown in Table 1.

TABLE 1

| Example No. | Colloidal inorganic substance Type | Amount (g/l) | Weight of anti-sticking layer ($g/m^2$) | Peeling of anti-sticking layer durihg a 5% skin pass process | Sticking strength ($g/cm^2$) | Durability of punching die (punching number x 10,000 | Feature of anti-sticking layer |
|---|---|---|---|---|---|---|---|
| Comparison Example 1 | 30% by weight colloidal silica | 300 | 0.01 | no | 450 | — | good |
| Example 1 | | | 0.02 | no | 85 | 150 | good |
| 2 | | | 0.05 | no | 25 | — | good |
| 3 | | | 0.1 | no | 15 | — | good |
| 4 | | | 0.5 | no | 15 | 120 | good |
| 5 | | | 0.8 | no but discolored | 10 | — | good |
| Comparison Example 2 | | | 1.2 | yes (minor parts) | 5 | — | sticky |
| 3 | | | 2.0 | yes (major parts) | — | — | sticky |
| 4 | 10% by weight alumina sol | 100 | 0.005 | no | 350 | — | good |
| 5 | | | 0.001 | no | 250 | — | good |
| Example 6 | | | 0.03 | no | 85 | — | good |
| 7 | | | 0.5 | no | 70 | 160 | good |
| 8 | | | 0.7 | no | 30 | — | good |
| Comparison Example 6 | | | 1.0 | yes (minor parts) | — | — | good |
| 7 | | | 2.0 | yes (major parts) | — | — | sticky |
| 8 | 30% by weight colloidal lithium silicate | 200 | 0.01 | no | 550 | — | good |
| Example 9 | | | 0.02 | no | 70 | — | good |
| 10 | | | 0.05 | no | 65 | — | good |
| 11 | | | 0.1 | no | 40 | — | good |
| 12 | | | 0.5 | no | 38 | 150 | good |
| 13 | | | 0.8 | no | 45 | — | good |
| Comparison Example 9 | | | 1.0 | yes (minor parts) | 25 | — | sticky |
| 10 | | | 1.5 | yes (major parts) | — | — | sticky |

EXAMPLE 14

In Example 14 procedures identical to those mentioned in Example 1 were carried out with the following exception. An annealed electrical steel sheet having a thickness of 0.5 mm was cooled to a temperature of 30° C. and coated with a coating liquid containing 230 g/l of a 30% by weight colloidal silica and 50 g/l of a 50% by weight of vinyl acetate-acrylonitrile copolymer emulsion. The coating liquid layer was dried for 2 seconds by blowing hot air having a temperature of 150° C. in a hot air dryer. The dried anti-sticking layer had a weight of 0.1 $g/m^2$. After the punching process was carried out the resultant shaped cores were superimposed and annealed at a temperature of 800° C. for 2 hours in an atmosphere consisting of 8% by weight of hydrogen gas and 92% by weight of nitrogen gas, to eliminate the strains from the strips.

It was found that the super hard punching die could repeat the punching operations 2,400,000 times on the coated electrical steel sheet. Also it was found that after the stress relief annealing process, the coated cores were easily separated from each other by hand.

From the above-mentioned examples and comparison examples, it is clear that electrical steel cores each having the anti-sticking layer can be easily separated from each other even after the stress relief annealing process at a high temperature and do not decrease the durability of the punching die. Also, it is clear that the anti-sticking layer formed on the electrical steel sheet in accordance with the process of the present invention has an excellent resistance to peeling during the temper rolling process. Furthermore, it should be noted that the anti-sticking layer can be easily formed by utilizing the heat maintained in the annealed electrical steel sheet just withdrawn from the continuous annealing furnace.

What is claimed is:

1. A process for producing an electrical steel sheet coated with an anti-sticking layer, comprising the steps of:

continuously annealing an electrical steel sheet;

applying, onto at least one surface of said annealed sheet, a coating liquid which consists essentially of at least one colloidal inorganic substance selected from the group consisting of colloidal silica, alumina sol, colloidal titanium oxide, colloidal lithium silicate and colloidal artificial mica, and which is in an amount sufficient enough for forming a dry anti-sticking layer having a weight of 0.02 to 0.8 g per $m^2$ of said surface, while said annealed sheet is kept at a temperature of from 50° to 150° C.;

drying said applied coating liquid on said surface by utilizing the heat remaining in said annealed sheet, and temper-rolling said dried sheet at a reduction of 0.2 to 10 percent.

2. A process as claimed in claim 1, wherein said coating liquid contains, in addition to said inorganic substance, at least one film-forming organic resinous substance.

3. A process as claimed in claim 1, wherein said electrical steel sheet is a cold-rolled low carbon laminated steel sheet.

4. A process as claimed in claim 2, wherein said organic resinous substance is selected from the group consisting of acrylic polymers, vinyl acetate polymers, polyester resins, alkyd resins, maleic acid resins, polyamide resins, phenol resins, melamine resins, epoxy resins and urea resins.

5. A process as claimed in claim 2, wherein the content of said organic resinous substance in said coating liquid is 50 percent or less based on the dry weight of said inorganic substance.

* * * * *